United States Patent [19]

Duinker et al.

[11] B 3,986,073

[45] Oct. 12, 1976

[54] LUMINESCENT SCREEN OF A COLOR TELEVISION TUBE

[75] Inventors: Hans Dignus Duinker; Gerardus Antonius Wilhelmus Vermeulen, both of Eindhoven, Netherlands

[73] Assignee: U.S. Philips Corporation, New York, N.Y.

[22] Filed: Aug. 11, 1972

[21] Appl. No.: 279,969

[44] Published under the second Trial Voluntary Protest Program on January 13, 1976 as document No. B 279,969.

[30] Foreign Application Priority Data

Aug. 18, 1971 Netherlands ..... 7111362

[52] U.S. Cl. ..... 313/477 R; 427/68; 427/105

[51] Int. Cl.[2] ..... H01J 31/12; H01J 29/18

[58] Field of Search ..... 117/33.5 CM, 33.1 C; 313/92, 477; 427/68, 105

[56] References Cited

UNITED STATES PATENTS

| | | | |
|---|---|---|---|
| 3,569,761 | 5/1971 | Lange | 117/33.5 CM |
| 3,615,460 | 10/1971 | Lange | 117/33.5 CM |
| 3,632,339 | 1/1972 | Khan | 117/33.5 CM |
| 3,661,581 | 5/1972 | Feldstein | 117/33.5 CM |
| 3,677,757 | 7/1972 | Nishizawa | 117/33.5 CM |
| 3,681,111 | 8/1972 | Kaplan | 117/33.5 CM |
| 3,695,871 | 10/1972 | Lange | 117/33.5 CM |
| 3,708,336 | 1/1973 | Nishizawa et al. | 117/33.5 CM |
| 3,734,728 | 5/1973 | Kachel | 117/33.5 CM |

*Primary Examiner*—Ralph Husack

*Attorney, Agent, or Firm*—Frank R. Trifari; George B. Berka

[57] ABSTRACT

A method of manufacturing a luminescent screen of a shadow mask color tube. The phosphor dots on the screen which are separated by a light-absorbing material are smaller than the apertures in the shadow mask. The light-absorbing layer is first provided on the window and the luminescent materials are then provided successively. The inner surface of the window is such that undulations having a spatial frequency from 5 to 50 $cm^{-1}$ or, in other words, wavelengths between 0.2 cm and 0.02 cm, show a depth of less than 1 micron.

1 Claim, No Drawings

LUMINESCENT SCREEN OF A COLOR TELEVISION TUBE

The invention relates to a method of manufacturing a luminescent screen of a cathode-ray tube for displaying colour pictures, comprising a shadow mask having a multitude of apertures, said luminescent screen comprising, in a multitude of separate areas, materials which upon excitation by electrons luminesce in different colors, said areas being separated by a light-absorbing material, the apertures in the shadow mask being larger than the effective areas of the luminescent materials, an apertured layer of the light-absorbing material being first provided on the window of the cathode-ray tube while using a photo-sensitive lacquer, the materials which upon excitation by electrons luminesce in different colours being then provided successively. The invention is further relative to a cathode-ray tube with a screen manufactured by this method.

A luminescent screen in which the surfaces of the luminescent materials are separated by a light-absorbing material has the advantage that, with the contrast remaining the same, the tinting of the window glass may be omitted or may at least be less. As a result of this the observed brightness of the picture increases. Since furthermore the apertures in the shadow mask are larger than the surfaces of the luminescent material, the electron spots are larger than the surfaces of the luminescent materials during operation of the tube with the same potential of the mask and the screen. Surfaces of the luminescent materials are always to be understood to mean herein the effective surfaces, that is to say the surfaces directly present on the screen, which thus contribute to displaying the picture. A part of the electrons of a given electron beam passed through a given aperture in the mask fully impinges upon the associated phosphor area, the remaining part of said passed electrons impinging upon the light-absorbing material present around said effective phosphor area. This case in which the size of the effective phosphor area is decisive of the size of each luminescent surface provides the possibility of an optimum realization of a picture display screen which comprises a light-absorbing material.

An apertured layer of the light-absorbing material is first provided on the window of the cathode-ray tube while using a photo-sensitive lacquer. This may be carried out in various manners.

For example, from the U.S. Pat. No. 3,146,368 a method is known in which the window is coated with a layer of a photo-sensitive lacquer having such properties that parts exposed to radiation are soluble in a solvent in which non-exposed parts are not soluble. The layer of the photo-sensitive lacquer is exposed to radiation in the places where the luminescent surfaces are provided afterwards and the exposed parts are removed by means of the said solvent. The light-absorbing material is either present already in the solution of the photo-sensitive lacquer or it is provided after exposing the photo-sensitive lacquer to radiation.

From British Patent Specification No. 1,180,195 a method is known in which the light-absorbing material itself is provided without the aid of a photo-sensitive lacquer. In this case the window is coated with a layer of a photo-sensitive lacquer having such properties that parts which are exposed to radiation are insoluble in a solvent in which non-exposed parts are soluble indeed.

The layer is exposed in the places where the effective luminescent surfaces are afterwards present and the unexposed parts are dissolved. On the window which is partly coated with exposed photo-sensitive lacquer a dispersion of colloidal graphite in water is provided which, after drying, adheres both to the uncoated window and to the photo-sensitive lacquer present. The parts present of the photo-sensitive lacquer with the graphite particles adhering thereto are then removed by means of a material which chemically attacks the hardened lacquer.

The exposure in both cases occurs through a shadow mask. When the luminescent screen comprises three luminescent materials, the exposure should be carried out three times. A light-absorbing layer always remains having apertures which are decisive of the size of the effective luminescent surfaces which are provided afterwards. Since the size of the apertures in the light-absorbing layer is determined by the size of the parts of the photo-sensitive lacquer hardened as a result of the exposures, said parts are decisive of the size of the effective luminescent surfaces. For convenience, this will hereinafter be explained with reference to the case in which a photo-sensitive lacquer is used which after exposure becomes insoluble.

When the apertures in the shadow mask at the time of providing the light-absorbing layer already have the size which they will have in the finished tube, parts should be hardened during the exposures of the photo-sensitive lacquer, which parts are smaller than the apertures in the shadow mask. A problem is still that in the case of three luminescent materials the photo-sensitive lacquer is exposed three times. As a result of this, the photo-sensitive layer comprises a very great number of hardened parts which are each surrounded, as a result of the half-shadow effect, by a part which has been exposed indeed but has not sufficiently hardened. It should be prevented that a part of the photo-sensitive layer which is not sufficiently hardened in one single exposure, is sufficiently hardened indeed in a subsequent exposure, which in itself would not result in a sufficient hardening, by the cumulation of exposures. For that purpose, the light distribution behind each mask hole should have a given shape and the photo-sensitive layer should meet certain requirements. It is desirable to use thin photo-sensitive layers (thickness approximately 1 micron).

It has been found that the photo-sensitive lacquer tends to equalize over the inner surface of the window. For several considerations, the window of a cathode-ray tube has a non-smooth inner surface. By using a so-called dotted inner surface it is prevented that possible irregularities of the glass, for example air inclusions, become visible during the use of the tube. For that purpose, for example, such a dotted inner surface comprises over a distance of 1 cm approximately 70 pits having a depth between 3 and 7 microns and a maximum diameter between 50 and 100 microns. This is obtained by using during pressing a die having a roughened surface. It has been found, however, that, inter alia as a result of the properties of the die, the inner surface of the window shows, in addition to the said unevenesses, undulations, for example, over a distance of 1 cm approximately 10 undulations having a depth of 10 to 15 microns. In fact, the pattern of the pits is superimposed upon the pattern of the undulations. Since the photosensitive lacquer tends to equalize over the inner surface of the window, comparatively considerable differences in thickness in the photo-sensitive layer occur as a result of the undulations. The result of this is that during the exposures a considerable spreading in the size of the hardened parts of the photo-sensitive layer occurs, while in addition considerable deviations from the shape of the hardened parts arise. The result of this is that an undesirable spreading in the diameter or the width of the apertures in the light-absorbing material is obtained and that undesirable deviations from shape of said apertures are present. The invention mitigates said drawbacks.

According to the invention, the inner surface of the window is such that undulations having a spatial frequency from 5 to 50 $cm^{-1}$ or, in other words, wavelengths between 0.2 cm and 0.02 cm, show a depth of less than 1 micron. This is of course to be understood to include also the case in which such undulations are absent.

When using such a window, only a very small spreading in the size of comparable apertures in the light-absorbing layer occurs and substantially no deviations from the shape of the apertures present themselves.

This of course also applies to the effective luminescent surfaces the size of which during operation of the tube cannot be influenced.

A window having such an inner surface that undulations having a spatial frequency from 5 to 50 $cm^{-1}$ show a depth of less than 1 micron can be obtained by polishing a window which does not have this property or by using a smooth die during pressing the window.

What is claimed is:

1. A cathode-ray tube for displaying color pictures, comprising: a transparent window having an undulated inner surface including undulations with a wavelength between 0.2 and 0.02 cm; a luminescent screen provided on said inner surface and including a plurality of luminescent areas which upon excitation by electrons luminesce in different colors, said areas being separated by light absorbing material, a shadow mask having a plurality of apertures, said apertures exceeding at least one dimension of assigned luminescent areas, said surface undulations with wavelengths between 0.2 cm and 0.02 cm having a depth less than 1 micron.

* * * * *